US006709087B2

(12) United States Patent
Ansell et al.

(10) Patent No.: US 6,709,087 B2
(45) Date of Patent: Mar. 23, 2004

(54) PRINTING DEVICE

(75) Inventors: Iain Ansell, Newmarket (GB); Steven Roland Brace, Cambridgeshire (GB)

(73) Assignee: Francotyp Postalia AG & Co., Birkenwerder (DE)

( * ) Notice: Subject to any disclaimer, the term of this patent is extended or adjusted under 35 U.S.C. 154(b) by 19 days.

(21) Appl. No.: 10/103,328

(22) Filed: Mar. 21, 2002

(65) Prior Publication Data

US 2002/0135633 A1 Sep. 26, 2002

(30) Foreign Application Priority Data

Mar. 21, 2001 (DE) ..... 101 14 541

(51) Int. Cl.[7] ..... B41J 2/165

(52) U.S. Cl. ..... 347/29; 347/30; 347/32; 347/33

(58) Field of Search ..... 347/29, 30, 32, 347/33

(56) References Cited

U.S. PATENT DOCUMENTS

| | | | | |
|---|---|---|---|---|
| 4,177,471 | A | 12/1979 | Mitchell | 347/37 |
| 4,461,212 | A | 7/1984 | Geney | 101/407.1 |
| 4,763,575 | A | 8/1988 | Miciukiewicz | 73/146 |
| 5,481,283 | A | 1/1996 | Watanabe et al. | 347/33 |
| 5,547,292 | A | 8/1996 | Harada | 400/58 |
| 5,627,573 | A | 5/1997 | Fahy | 347/32 |
| 6,024,435 | A | 2/2000 | Muraki | 347/32 |

FOREIGN PATENT DOCUMENTS

| | | |
|---|---|---|
| DE | 38 11 539 A1 | 10/1988 |
| DE | 195 02 433 A1 | 8/1995 |
| DE | 200 12 946 U1 | 10/2000 |
| EP | 0 591 844 A1 | 4/1994 |
| EP | 0 405 356 B1 | 11/1994 |
| EP | 0 720 912 A2 | 7/1996 |
| EP | 0 832 746 A1 | 4/1998 |
| JP | 04 131 249 | 5/1992 |

*Primary Examiner*—Shih-Wen Hsieh
(74) *Attorney, Agent, or Firm*—Laurence A. Greenberg; Werner H. Stemer; Gregory L. Mayback

(57) ABSTRACT

A printing device, in particular a franking machine, has a print head that can be moved along a first direction into a first longitudinal position, and a station that cooperates with the print head in the first longitudinal position. The print head is cleaned and/or maintained and/or retained and preserved at the station. The print head is designed and/or arranged to move toward the station in a second direction that extends transversely with respect to the first direction in order to cooperate with the station.

18 Claims, 8 Drawing Sheets

PRINTING DEVICE

BACKGROUND OF THE INVENTION

FIELD OF THE INVENTION

The present invention relates to a printing device, in particular a franking machine, having a print head that can be moved along a first direction into a first longitudinal position and a station, provided to cooperate with the print head located in the first longitudinal position, for cleaning and/or maintaining and/or retaining and storing the print head.

Particularly in the context of printers that operate on the ink jet principle, it is generally necessary to maintain the print head regularly, that is to say among other things to "fire" the nozzles in accordance with a specific pattern without any medium to be printed and to wipe off the row or rows of nozzles with a wiper in order to remove contaminants.

Furthermore, it is necessary to cover the nozzles of the print head when they are not used for a relatively long time, by means of a cap or the like which makes appropriately tight contact in order to prevent the ink from drying out and therefore the nozzles from becoming blocked. In order to achieve the covering seal, the cap generally has a relatively soft peripheral edge, which defines a plane parallel to the first direction, that is to say the direction of travel of the print head, and can be placed sealingly around a ledge on the print head. For the purpose of covering, the print head is moved from the outside against this edge of the cap, the edge being deformed because of its elasticity and giving way to the print head. Once the print head has then reached its end position with respect to the cap, the edge can return into its original shape and is placed around the ledge on the print head.

However, that prior art device has the disadvantage that the cap is firstly subjected to relatively high wear because of the frequent deformation. In addition, it is relatively complicated to produce, since some tolerances have to be complied with in order in fact to achieve a good sealing behavior from the cap.

In other devices of the generic type, such as the one disclosed, for example, in U.S. Pat. No. 5,627,573 (European patent application EP 0 720 912 A2), it is proposed to lift the cap against the print head by an appropriate mechanism to be operated as the print head moves, in order in this way to achieve the sealing. In that case, although comparatively good sealing is achieved with low wear of the cap, the print head has to be moved relatively far in the first direction in order to produce the appropriate stroke for the cap. In addition, because of the operating mechanism for the cap, which has to be integrated, the station is relatively large and complicated. Both aspects lead to a configuration that is generally undesirably large.

SUMMARY OF THE INVENTION

It is accordingly an object of the invention to provide a printing apparatus, which overcomes or at least limits the above-mentioned disadvantages of the heretofore-known devices and methods of this general type to a minimum and which ensure simple, cost-effective production with a low overall size.

With the foregoing and other objects in view there is provided, in accordance with the invention, a printing device, in particular a franking machine, comprising:

a print head movably disposed along a first direction into a first longitudinal position;

a station disposed to cooperate with the print head located in the first longitudinal position for one of cleaning, maintaining, and retaining the print head; and the print head being movable toward the station in a second direction transverse to the first direction, for cooperating with the station.

That is, the print head is either configured to be movable in the second direction, and/or movably mounted in the second direction.

The present invention is based on the technical teaching that a configuration which is simple and cost-effective to produce and takes up little overall space may be achieved if the print head, in order to cooperate with the station, is configured and/or arranged to move toward the station in a second direction running transversely with respect to the first direction.

It has been shown that, by using such a configuration, ultimately smaller configurations may be achieved. Because of the overall space occupied by it as compared with the station or its individual components, the print head provides more possible ways for an ultimately simpler and smaller configuration of a mechanism via which the print head and station can be moved toward each other. The necessary guides and drive means or drive devices can be configured to be correspondingly larger and simpler, without the overall space required for this being increased significantly. In particular, because of the comparatively large extent of the print head, more free space is available for the distribution of the individual functional elements, which results in a considerably simpler, more robust configuration.

The travel movement of the print head along the second direction can be achieved in any desired way. For example, the print head can complete a simple linear movement along the second direction, in order to be moved toward the station. This can be carried out after the print head has already reached its first longitudinal position. The movement along the second direction can, however, also start while the print head is still being moved along the first direction, so that the print head ultimately approaches the station on a planar curved path.

In particularly simple variants of the device according to the invention, provision is made for the print head to be designed or arranged such that it can be pivoted about a pivot axis running substantially parallel to the first direction. The pivoting mounting may be achieved in a particularly simple and small manner. The pivoting mounting is preferably simply formed by the appropriately configured longitudinal guide of the print head along the first direction, which also results in an additional space saving.

In order to effect the movement along the second direction, a separate drive can be provided. However, the movement along the second direction is preferably achieved by moving the print head along the first direction, in order in this way to save an additional drive.

In this case, a guide device designed to cooperate with the print head is preferably provided in order to guide the print head during the movement in the second direction when the print head is moving along the first direction. By this means, in a simple way, a defined movement of the print head in the direction of the station can be achieved. In this case, the accelerations acting on the print head during the movement can additionally also be adjusted by means of appropriate configuration of the guide device.

The guide device can be formed by one or more separate components. It is preferably formed as part of a longitudinal guide provided to guide the print head along the first direction, so that a further space saving is achieved.

As mentioned above, the movement along the second direction is preferably achieved by moving the print head along the first direction. In advantageous variants, provision is made, to this end, for the guide device to be designed to effect the movement of the print head along the second direction. In other words, the guide device acts on the print head in such a way that the latter is moved along the second direction.

In this case, a first guide face on the guide device generally cooperates with a second guide face on the print head. In order to ensure defined guidance of the print head, it is preferably ensured that the first and second guide faces make contact with each other during the entire movement. This can be done by the guide being designed in the manner of a positive guide. Likewise, however, it is possible to ensure, by suitable means, for example by springs but also by the force of gravity, that a contact force always acts between the two guide faces.

In particularly simply configured variants of the device according to the invention, the print head is designed or arranged to move toward the station in the second direction on account of its weight. In this case, as already mentioned, it can preferably be guided by a guide device in order to ensure a defined movement in the direction of the station.

The station can be configured and designed in any desired known way. The station preferably comprises a cap for covering the printing elements of the print head. In order to achieve an efficient sealing force acting during the cooperation with the print head, the cap is preferably mounted in a sprung manner in the station, at least along the second direction. In this case, the sprung mounting not only ensures the sealing force but also permits the compensation of positioning inaccuracies between the print head and the cap. Particularly good compensation for such inaccuracies results when the mounting of the cap is additionally designed in such a way that it can be moved transversely with respect to the second direction within specific limits.

In further preferred variants, the station comprises a wiping device for wiping the outlet region of the printing elements of the print head and, in addition or alternatively, further functional elements of conventional stations for cleaning, maintaining or preserving the print head.

In the sense of the present invention, the term print head is to be understood to mean not just that part of a printing device which contains the printing elements, for example the nozzles. Instead, the term is also to comprise structural units from the printing elements and associated storage containers for the printing medium, and also possible mountings into which such structural units are inserted. Otherwise, it goes without saying in this case that the invention may be applied to print heads operating in accordance with any desired printing principles.

Furthermore, the movement of the print head toward the station is not intended to be interpreted to the effect that the entire print head is moved toward the station as a self-contained unit. Instead, it may be sufficient if the part of the print head that carries the printing elements and which is ultimately certainly intended to cooperate with the maintenance station is moved toward the station.

Other features which are considered as characteristic for the invention are set forth in the appended claims.

Although the invention is illustrated and described herein as embodied in a printing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
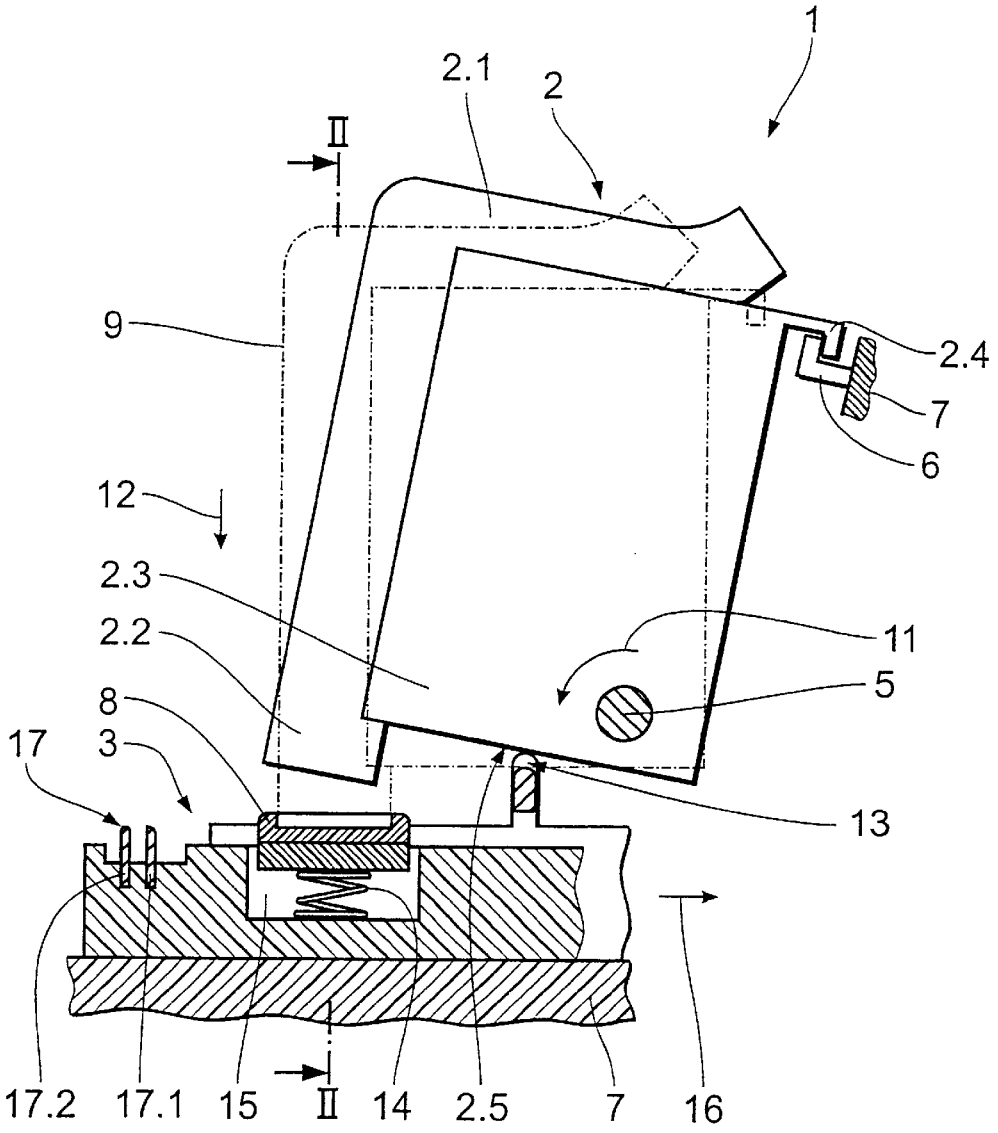
FIG. 1 is a schematic, partial sectional view of a preferred embodiment of a device according to the invention.
Figure 2:
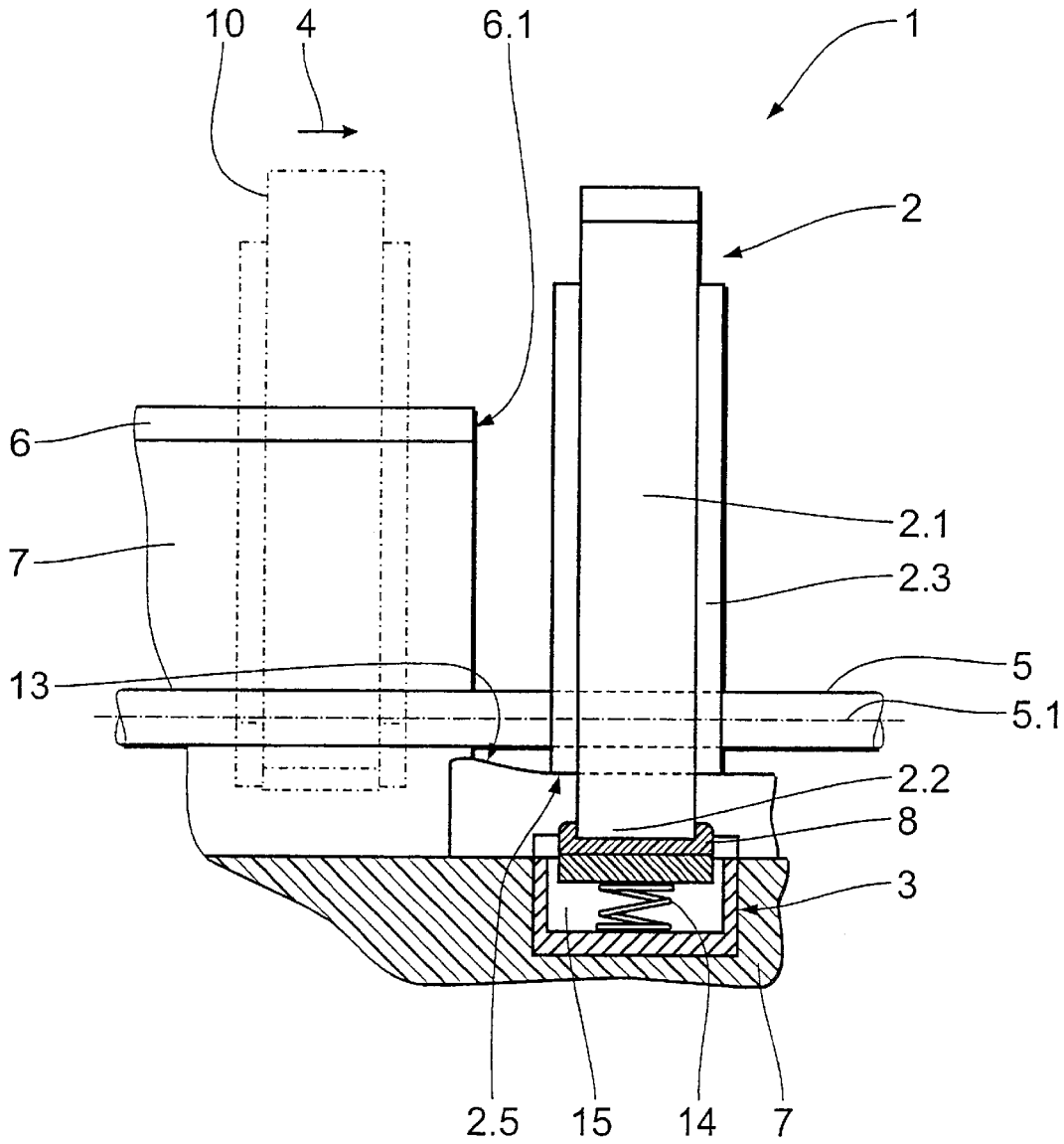
FIG. 2 is a schematic, partial sectional view through the device along the line II—II in FIG. 1.

Referring now to the figures of the drawing in detail and first, particularly, to FIGS. 1 and 2 thereof, there is shown a preferred embodiment of the device according to the invention in the form of a franking machine 1 having a print head 2 and a maintenance station 3. In order to print, the print head 2 can be moved along a first direction 4 by drive means—not illustrated. In this case, the print head 2 is guided by guide elements, which comprise a cylindrical longitudinal guide rod 5 and a longitudinal guide channel 6, which are both fixed to the housing 7 of the franking machine 1.

The print head 2 operates in accordance with an inkjet principle. It comprises a cartridge 2.1 which is configured in the conventional way and which, in addition to the ink supply, carries the printing nozzles on an extension 2.2. Furthermore, it comprises a mount 2.3, in which the cartridge 2.1 is held such that it can be replaced.

In FIGS. 1 and 2, the print head 2 is illustrated in different longitudinal positions with respect to the first direction 4. Thus, in FIG. 2, it is illustrated in its first longitudinal position, in which it cooperates with the maintenance station 3 to the extent that its extension 2.2 is seated in a cap 8 belonging to the maintenance station 3. In the process, the cap 8 covers the printing nozzles of the cartridge 2.1 in a sealing manner and, in this way, during relatively long non-use of the print head, prevents the ink in the printing nozzles drying out and therefore their becoming blocked. In this case, the print head 2, which can be pivoted about the longitudinal axis 5.1 of the longitudinal guide rod 5, parallel to the first direction 4, as a result of the cylindrical configuration of the longitudinal guide rod 5, is located in a first pivoting position.

In FIG. 1, the print head 2 is illustrated in a second longitudinal position, remote from the first longitudinal position, in which it is located in a second pivoting position. This results from its hook-like attachment 2.4 engaging in the longitudinal guide channel 6, as a result it is held in its second pivoting position, illustrated in FIG. 1, over the major part of its travel along the first direction 4.

The longitudinal positions of the print head 2 illustrated in FIGS. 1 and 2 are indicated in the respective other figure by an appropriate contour. Thus, the contour 9 in FIG. 1 indicates the first longitudinal position illustrated in FIG. 2 and the first pivoting position of the print head 2, or the contour 10 in FIG. 2 represents the second longitudinal position illustrated in FIG. 1 and the second pivoting position of the print head 2.

If the print head 2 is moved in the first direction 4 from its second longitudinal position—indicated by the contour 10 in FIG. 2—, the hook-like attachment 2.4 is detached from engagement with the longitudinal guide channel 6 at the end 6.1 of the longitudinal guide channel 6, the print head 2 then tending to pivot in the direction of the arrow 11 about the longitudinal guide rod 5 as a result of its weight and accordingly to move in a second direction 12 toward the maintenance station 3.

In order to achieve a defined pivoting movement of the print head 2 from its second pivoting position into its first pivoting position as it moves further in the first direction 4, a guide device in the form of a guide track 13 is provided, which cooperates with a run-on face 2.5 on the print head 2. As a result of its weight, the print head 2 is forced with its run-on face 2.5 against the guide track 13. The guide track 13 has a curved course which is inclined with respect to the first direction over long distances, so that the attachment 2.4 of the print head 2 is lowered slowly in the second direction 12 of the cap 8 as it moves in the first direction 4, until it is seated in the cap 8 in the first longitudinal position of the print head 2.

When the print head 2 is moved from its first longitudinal position in the direction counter to the first direction 4, the print head 2 is again pivoted appropriately by the guide track 13 until its hook-like attachment 2.4 again comes into engagement with the longitudinal guide channel 6 and is then held by the latter in its second pivoting position.

As a result of the configuration, in particular the selected inclined course of the guide track 13 with respect to the first direction 4, the pivoting movement of the print head 2 and therefore the acceleration acting on it can be set within wide limits. In particular, it can be set in such a way that the wear on the guide track 13 and the run-on face 2.5 is kept as low as possible.

As can be gathered from FIGS. 1 and 2, in the maintenance station 3, the cap 8 is mounted in a recess 15 such that it can be moved by a spring 14. The arrangement of the cap 8 and the guide track 13 is coordinated with each other in such a way that the spring 14 compresses slightly in the first pivoting position of the print head 2, in which the cap 8 closes the extension 2.2, as a result of the weight of the print head 2. In this way, a closing force between the cap 8 and the extension 2.2 is ensured.

The cap 8 has relatively large play in relation to the adjacent walls of the recess 15. This ensures that, by means of appropriate deformation of the spring 14, angular inaccuracies between the cap 8 and the extension 2.2 are compensated for.

The maintenance station 3 can be moved in the direction of the arrow 16 by drive means—not illustrated. In this way, it is possible to bring the printing nozzles on the extension 2.2, in the second pivoting position of the print head 2, into contact with a wiping device 17 in the form of two wiping lips 17.1 and 17.2 for cleaning purposes.

It goes without saying that the maintenance station, in other variants, can also comprise still further functional units. For example, a reservoir can be provided, into which the printing nozzles are likewise "fired" in accordance with a predefined pattern for cleaning purposes. Likewise, provision can be made for the cap to be connected to a suction device which, in the covered state, sucks ink out of the printing nozzles.

Figure 4:
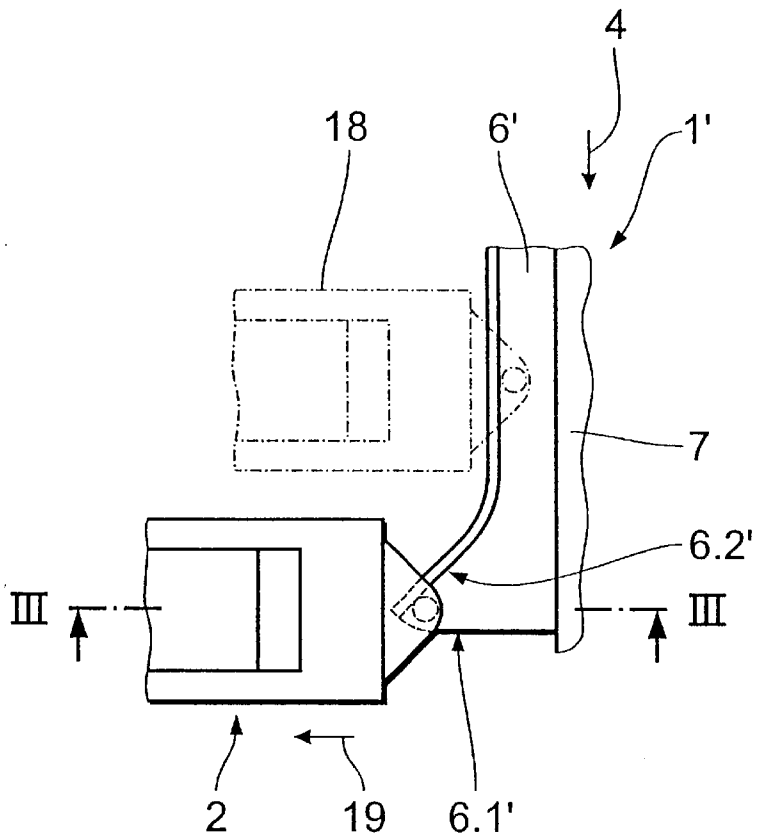
FIG. 4 is a schematic partial view of the device of FIG. 3 viewed in the direction of the arrow IV, and further indicating the section line III—III of FIG. 3.
Figure 3:
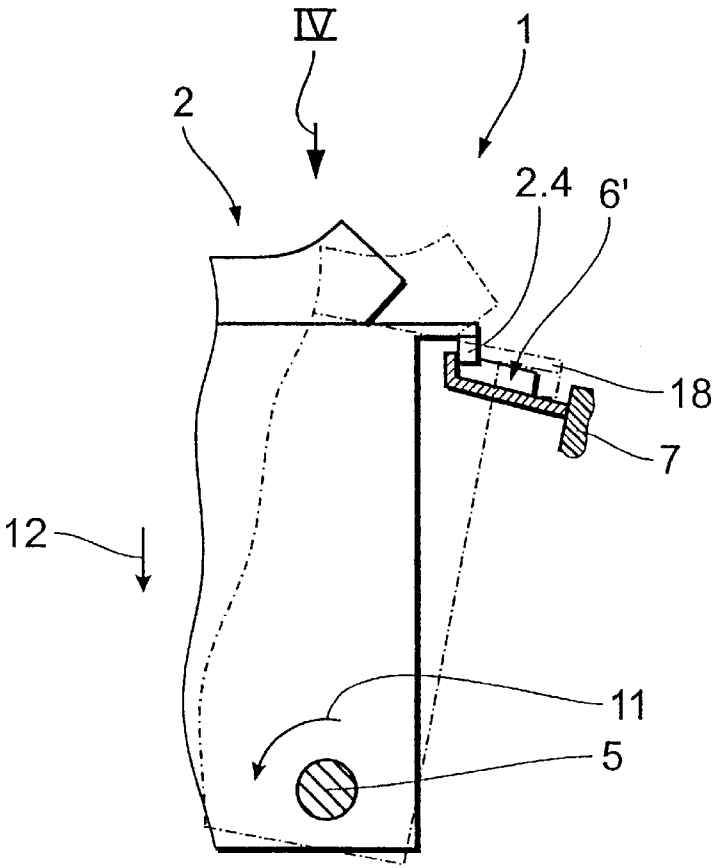
FIG. 3 is a schematic partial section of a further preferred embodiment of a device according to the invention.

FIGS. 3 and 4 show details of a further preferred exemplary embodiment of the franking machine 1' according to the invention which, in its fundamental construction and its fundamental function, equates to that from FIGS. 1 and 2, but the intention is merely to discuss the differences. In this case, as compared with the variant from FIGS. 1 and 2, unchanged components are provided with the same reference symbols as in FIGS. 1 and 2.

The difference is that the guide device which performs the guidance of the print head 2' as it is pivoted from the second pivoting position, indicated by the contour 18, into the second pivoting position illustrated in FIGS. 3 and 4, is not formed by a separate component but is implemented by means of appropriate configuration of the longitudinal guide channel 6'.

In this case, the longitudinal guide channel 6' widens more and more in the first direction 4 in a section 6.2' toward its end 6.1', so that the hook-like attachment 2.4 that is pressed against the section 6.2' because of the weight of the print head 2 moves further and further in the direction of the arrow 19 during movement in the first direction 4, as a result of which the print head 2 is pivoted in the direction of the arrow 11 into its second pivoting position.

Here, too, the longitudinal guide channel 6' in the region of the second 6.2' has a curved course which is inclined with respect to the first direction over long distances, so that the extension on the print head 2 that bears the printing nozzles is lowered slowly in the second direction 12 onto the cap—not illustrated—during movement in the first direction 4, until it is seated in the cap in the illustrated first longitudinal position of the print head 2.

Figure 6:
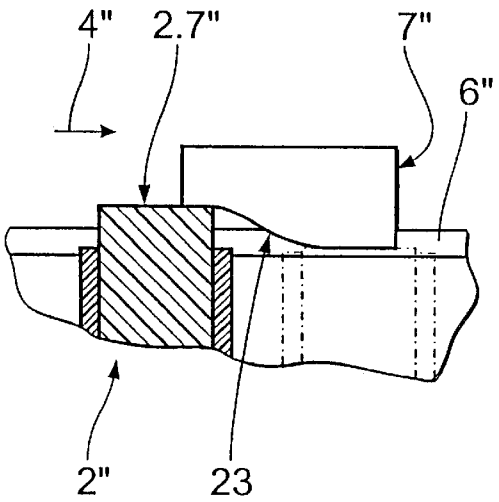
FIG. 6 is a partial and partly sectional view through the device along the line VI—VI in FIG. 5.
Figure 5:
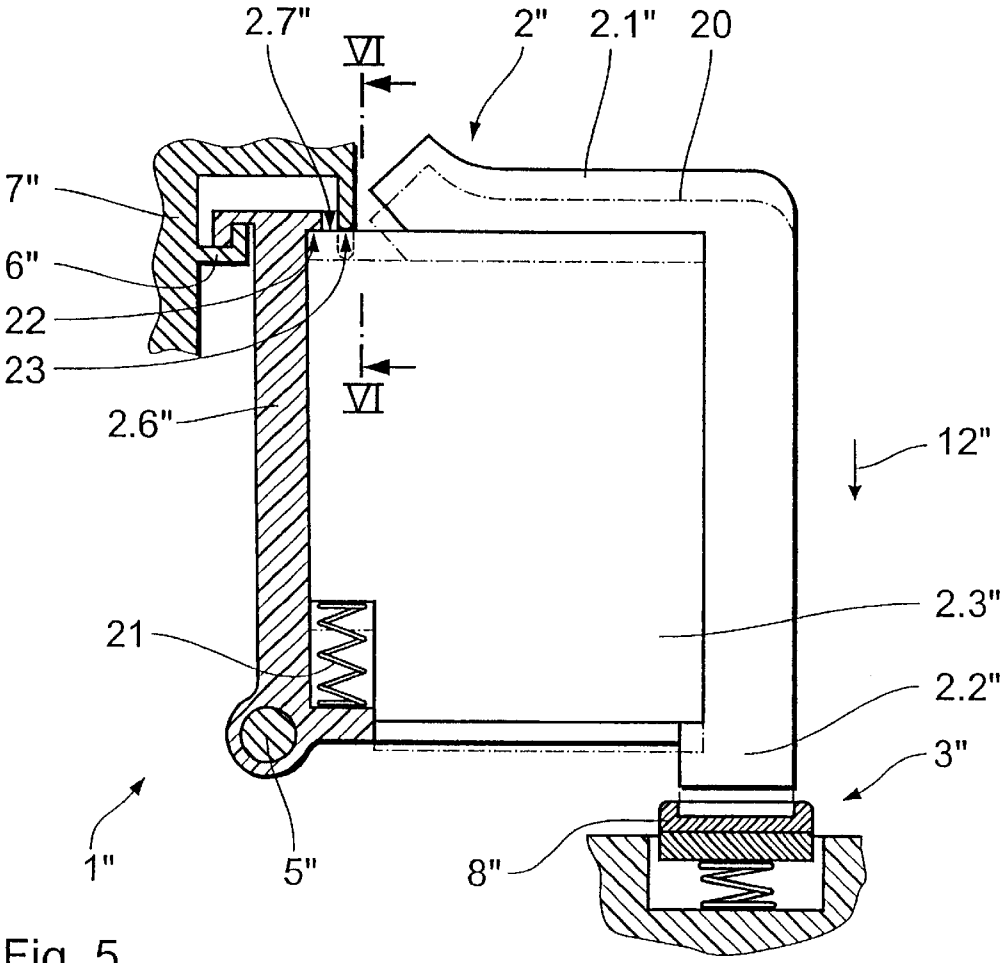
FIG. 5 is a schematic, partial sectional view of a further preferred embodiment of a device according to the invention.

FIGS. 5 and 6 show part views of a further preferred variant of the device according to the invention in the form of a franking machine 1" having a print head 2" and a maintenance station 3". For the purpose of printing, the print head 2" can be moved along a first direction 4" by drive means—not shown. In this case, the print head 2" is guided by guide elements which comprise a cylindrical longitudinal guide rod 5" and a longitudinal guide channel 6", which are both fastened to the housing 7" of the franking machine 1".

The print head 2" also operates in accordance with an ink jet principle in this variant. It comprises a cartridge 2.1" which is configured in a conventional way and which, in addition to the ink supply, carries the printing nozzles on an extension 2.2". Furthermore, it comprises a first mount 2.3", in which the cartridge 2.1" is held such that it can be replaced. This first mount 2.3" is seated such that it can move along the second direction 12" in a second mount 2.6", which is guided by the guide elements 5" and 6".

In FIGS. 5 and 6, the print head 2" is illustrated in a second longitudinal position with respect to the first direction 4". Its first longitudinal position, in which it cooperates with the maintenance station 3" to the extent that its extension 2.2" is seated in a cap 8" belonging to the maintenance station 3", is indicated by the contour 20 in both figures. In this case, the cartridge 2.1" is located in a first transverse position with respect to the second direction 12", in which the cap 8" covers the printing nozzles of the cartridge 2.1" in a sealing manner and thus, during relatively long non-use of the print head, prevents the ink drying out in the printing nozzles and therefore their becoming blocked.

The first mount 2.3" is biased by a spring 21 against a stop 22, which defines a second transverse position of the cartridge 2.1" with respect to the second direction 12" and also the upper end position of the first mount 2.3". In order to move the cartridge 2.1" in the second direction 12" during the movement of the print head 2" in the first direction 4" toward the maintenance station 3", a guide track 23 is required on the housing 7, cooperating with a run-on face 2.7" on the first mount 2.3".

The guide track 23 has a curved course inclined over long in distances in relation to the first direction 4". During the movement of the print head 2" in the first direction 4", the first mount 2.3" and therefore also the cartridge 2.1" is pressed downward in the second direction 12" by the guide track 23, counter to the spring force of the spring 21, until the extension 2.2" is finally seated in the cap 8" when the first longitudinal position of the print head 2" is reached.

As a result of the configuration, in particular the selected inclined course of the guide track 23 with respect to the first direction 4, the course of the track of the approach movement of the first mount 2.3" with the cartridge 2.1", and therefore the acceleration acting on the latter, can be set within wide limits. In particular, they can be set in such a way that the wear on the guide track 23 and the run-on face 2.7" is kept as low as possible.

During the movement of the print head 2" from its first longitudinal position in the direction opposite to the first direction 4", the first mount 2.3" with the cartridge 2.1", bounded by the guide track 13, is correspondingly lifted again in the direction opposite to the second direction 12", because of the restoring forces from the spring 21, until it strikes the stop 22 again, which defines its second transverse position.

In terms of its configuration, the maintenance station 3" corresponds to the maintenance station 3 from FIGS. 1 and 2, so that with respect to the details, reference is made to the corresponding description relating to FIGS. 1 and 2.

Figure 8:
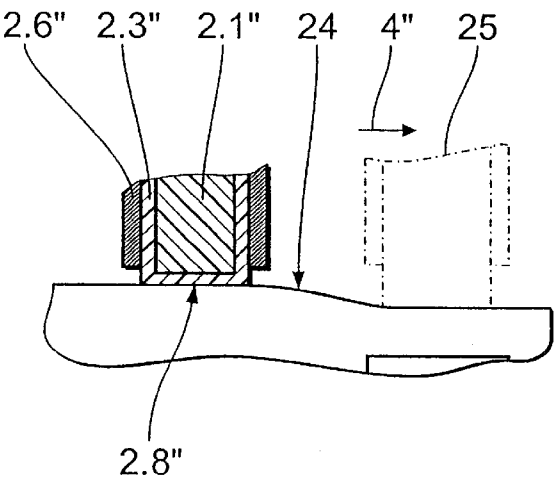
FIG. 8 is a schematic, partial sectional view through the device taken along the line VIII—VIII in FIG. 7.
Figure 7:
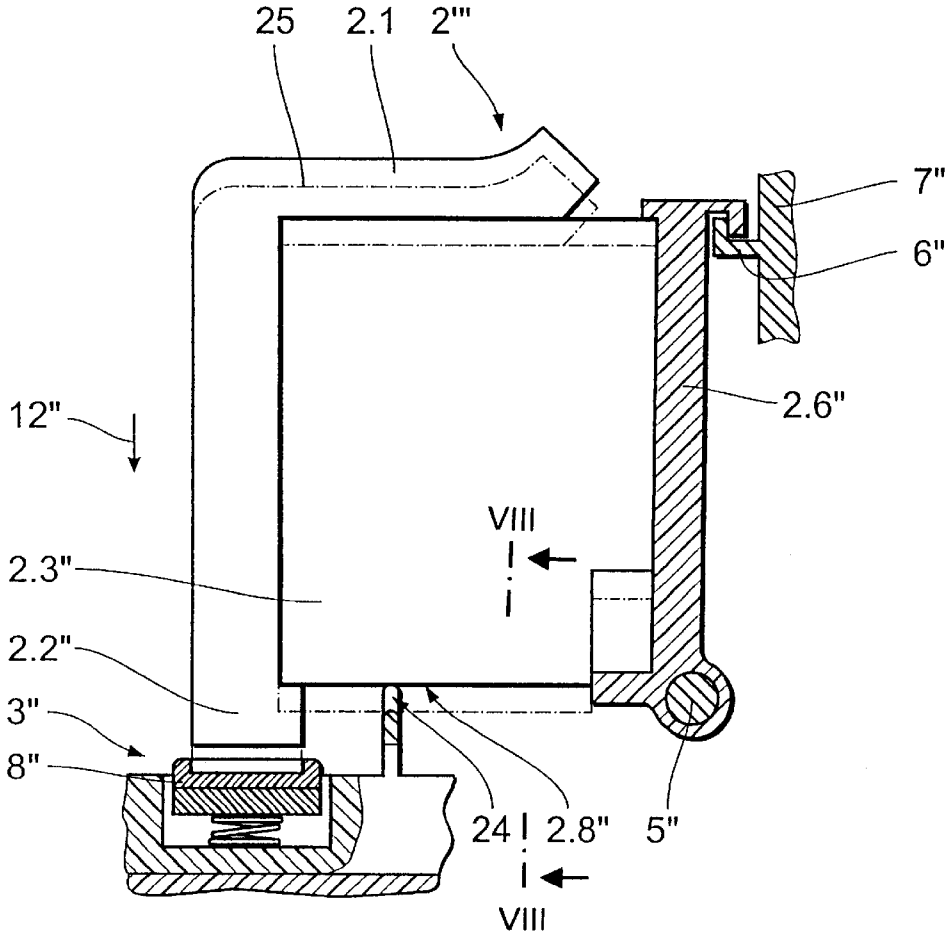
FIG. 7 is a schematic, partial sectional view of a further preferred embodiment of a device according to the invention.

FIGS. 7 and 8 show a further preferred variant of the franking machine 1'" according to the invention which, in its fundamental construction and its fundamental function, equates to that from FIGS. 5 and 6, so that only the differences will be discussed. In this case, components which are unchanged with respect to the variant from FIGS. 5 and 6 are provided with the same reference symbols as in FIGS. 5 and 6.

The difference is that there is no spring which biases the first mount 2.3" in the direction opposite to the second direction 12" against a corresponding stop. Instead, the first mount 2.3" can move freely in relation to the second mount 2.6" and, as a result of its weight, is seated on a guide track 24, which cooperates with a run-on face 2.8" on the first mount 2.3".

In this case, the guide track 24 constitutes the guide device, which performs the guidance of the first mount 2.3" and therefore of the cartridge 2.1" during the movement from the illustrated second transverse position into the first transverse position indicated by the contour 25 in FIGS. 5 and In order to achieve a defined travel movement of the cartridge 2.1" from its second transverse position into its first transverse position during the movement in the first direction 4", the guide track 13 has a curved course inclined over long distances in relation to the first direction 4", so that the extension 2.2" of the cartridge 2.1" is lowered slowly onto the cap 8" in the second direction 12" during the movement in the first direction 4", until it is seated on the cap 8" in the first longitudinal position of the print head 2".

During the movement of the print head 2" from its first longitudinal position counter to the first direction 4", the first mount 2.3" with the cartridge 2.1" is again lifted appropriately in the direction opposite to the second direction 12" by the guide track 24. In this case, the guide track 24 extends over the entire travel of the print head 2", so that it determines the transverse position of the cartridge 2.1" in every longitudinal position of the print head 2".

As a result of the configuration, in particular the selected inclined course of the guide track 24 with respect to the first direction 4", the transverse movement of the cartridge 2.1" and therefore the acceleration acting on it can be set within wide limits. In particular, it can be set in such a way that the wear on the guide track 24 and the run-on face 2.8" is kept as low as possible.

Figure 9:
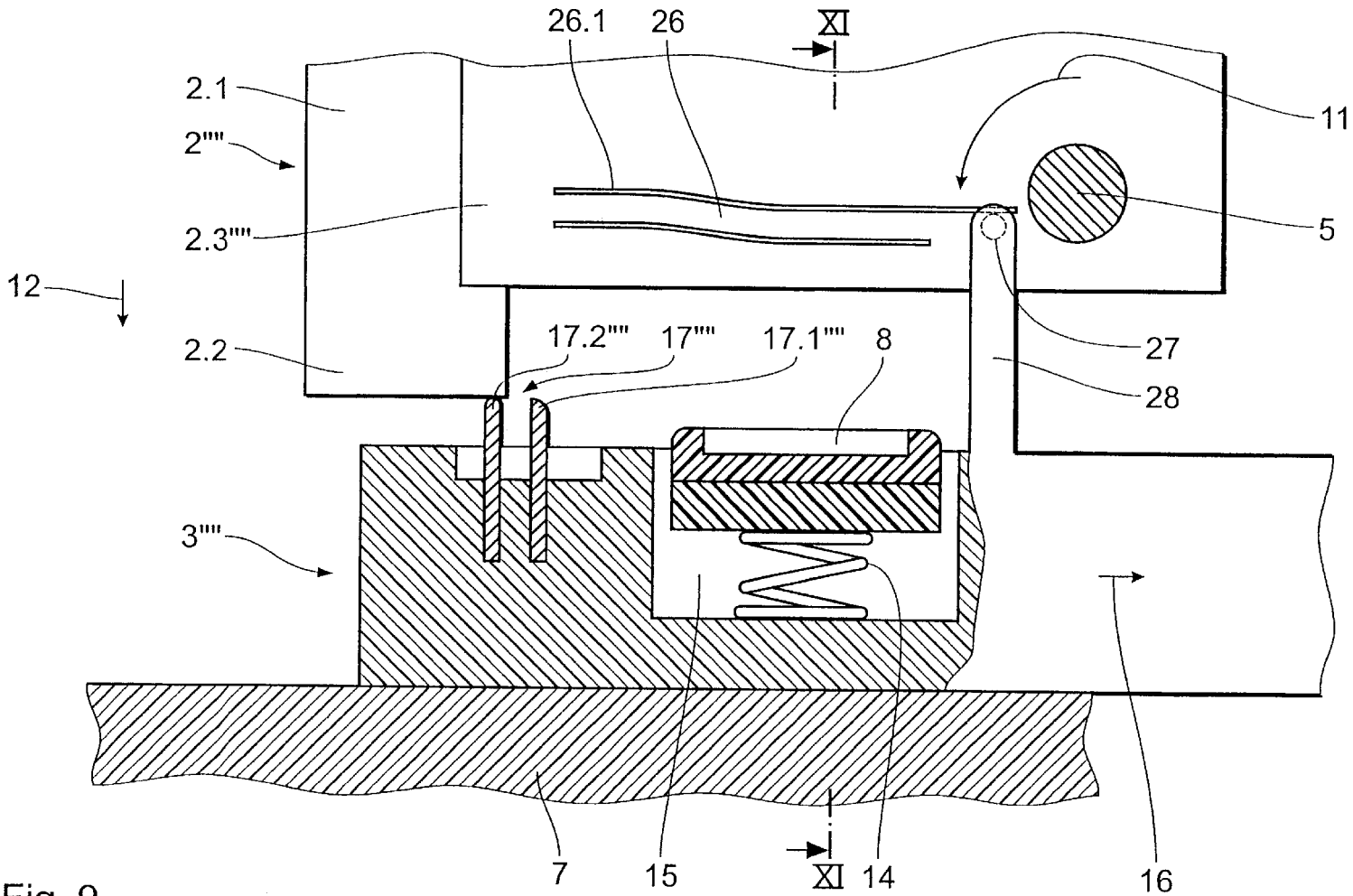
FIG. 9 is a schematic, partial sectional view of a further preferred embodiment of a device according to the invention.
Figure 10:
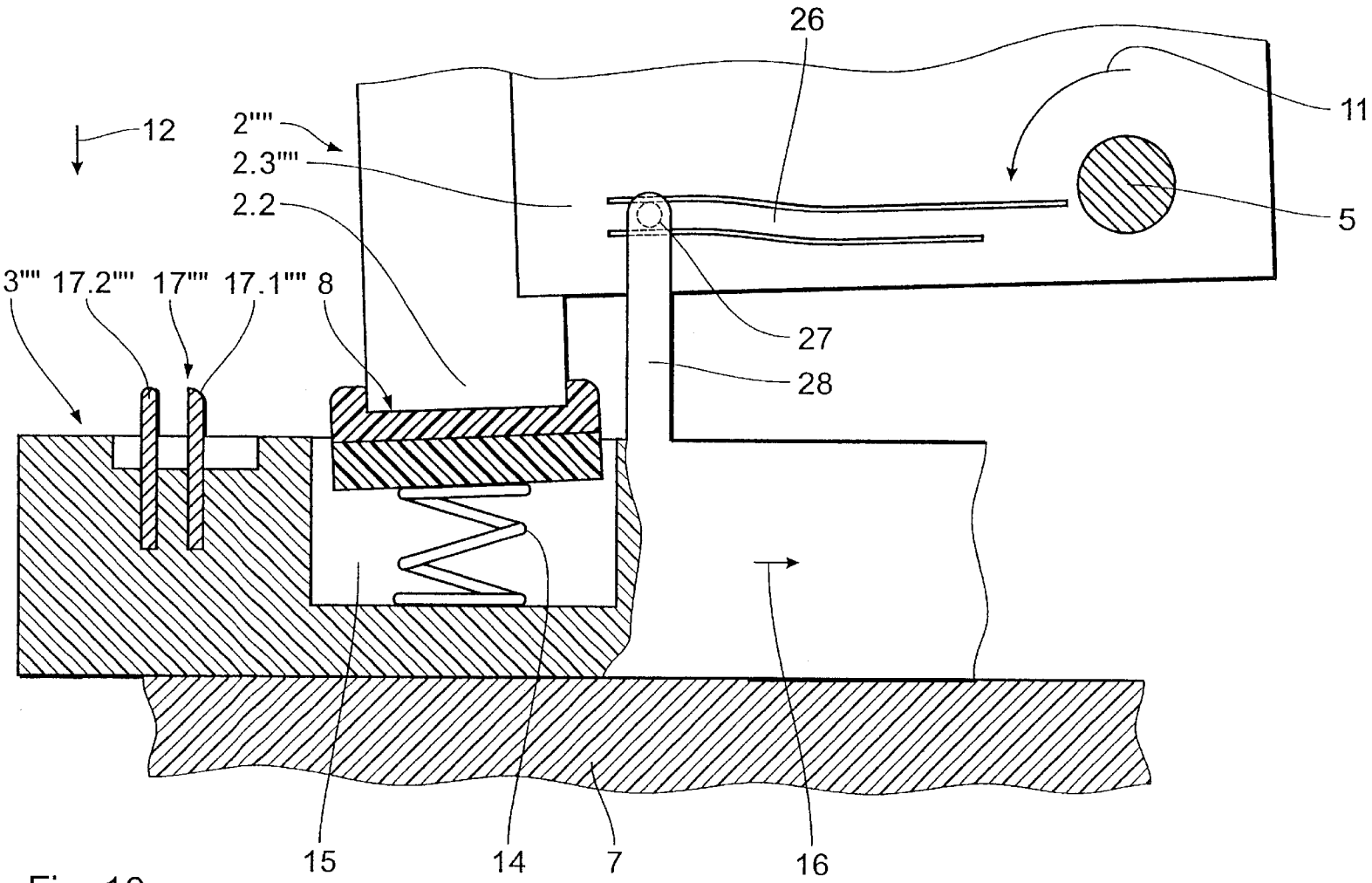
FIG. 10 is a schematic, partial sectional view of the device of FIG. 9 in a different operating position.
Figure 11:
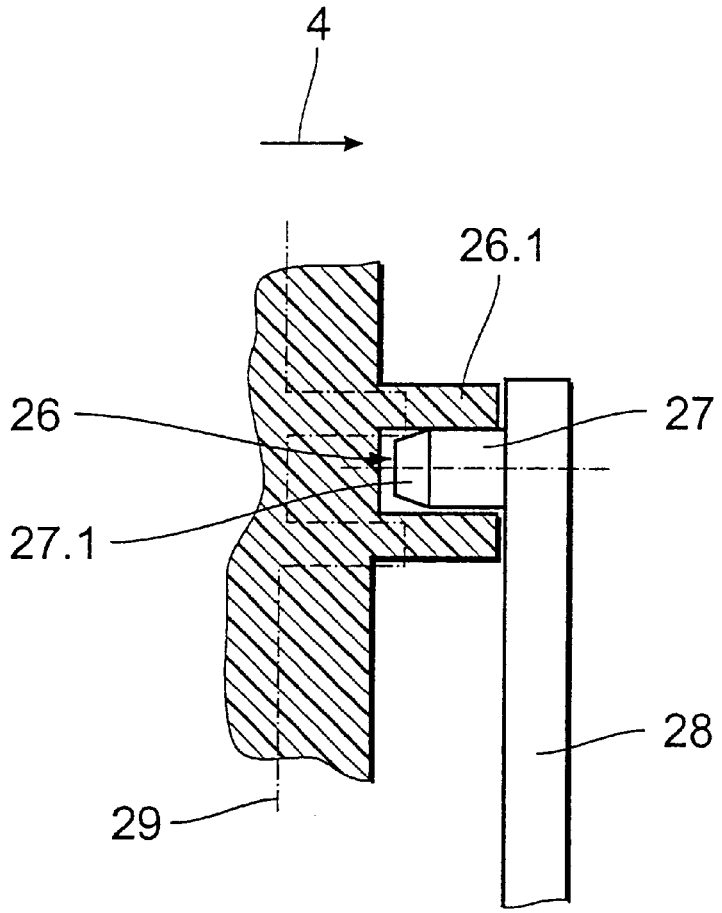
FIG. 11 is a schematic, partial sectional view through the device taken along the line XI—XI in FIG. 9.

FIGS. 9 to 11 show schematic part sections through a further preferred embodiment of the device according to the invention which, in its fundamental construction and its fundamental function, equates to that from FIG. 1, so that only the differences will be discussed. In particular, identical components are provided with the same reference numbers.

The difference is that, in order to achieve a defined pivoting movement of the print head 2"" from its second pivoting position into its first pivoting position, a guide device in the form of a guide track 26 is provided on the mount 2.3"" and cooperates with a guide pin 27 which is fixed to a carrier element 28 belonging to the maintenance station 3"".

Differing from the variant from FIG. 1, the print head 2"" is not pivoted from its first pivoting position, illustrated in FIG. 9, into its second pivoting position, illustrated in FIG. 10, by means of further movement in the first direction 4. Instead, with the print head 2"" located in its first longitudinal position, this is achieved by moving the maintenance station 3"" in the direction opposite to the direction 16.

In the process, the extension 2.2 on the cartridge 2.1 that carries the printing nozzles firstly comes into contact with the wiping lips 17.1"" and 17.2"" of the wiping device 17"" and is swept over by the latter in order to clean the printing nozzles. As soon as the wiping lips 17.1"" and 17.2"" are no longer in contact with the extension, the guide pin 27 reaches a region 26.1 of the guide track 26 which runs at an angle with respect to the direction 16. By this means, the print head 2"" is pivoted from its first pivoting position into its second pivoting position, in the direction opposite to the direction 16, during the further movement of the maintenance station 3"".

In the final phase of the movement, not only does the inherent weight of the print head 2"" contribute to this pivoting movement but, as soon as the spring force of the spring 14 balances this movement, so does the positive guidance by the guide track 26. The latter pulls the print head 2"" and therefore the extension 2.2 of the cartridge 2.1 downward in the second direction 12 and onto the cap 8, which achieves good sealing. In this case, by virtue of its mounting by means of the spring 14—described extensively in relation to the variant from FIG. 1—the cap 8 is able to compensate for the angular deviation between the extension 2.2 and the cap 8.

As can be gathered from FIG. 11, the guide pin 27 has a conical run-on face. During movement of the print head 2"", in the first direction 4, the side wall 26.1 of the guide track 26 runs against this run-on face 27.1—as indicated by the contour 29. By this means, the print head 2"" is lifted slightly as it moves further in the first direction 4, as a result of which its hook-like attachment 2.4—not illustrated in FIGS. 9 to 11—is lifted slightly off the longitudinal guide channel 6—not illustrated in FIGS. 9 to 11. Only after this has been done does the hook-like attachment 2.4 reach the end 6.1 of the longitudinal guide channel 6 during the further movement of the print head 2"" in the first direction 4, the print head 2 then already being held in its second pivoting position by the guide pin 27. This configuration ensures that the print head 2"" is, so to speak, transferred from one guide device to the other guide device without jamming.

In order to move the print head 2 from its first longitudinal position in the direction opposite to the first direction 4, it must first be brought into its first pivoting position again by moving the maintenance station 3"" in the direction 16. It is then moved in the direction opposite to the first direction 4, until its hook-like attachment 2.4 has again come into engagement with the longitudinal guide channel 6 and is then held by the latter in its second pivoting position.

As a result of the configuration, in particular the selected inclined course of the guide track 26 with respect to the direction 16, the pivoting movement of the print head 2 and therefore the acceleration acting on it can be set within wide limits. In particular, it can be set in such a way that the wear on the guide track 26 and the guide pin 27 is kept as low as possible.

Although the invention has been described above only by using the example of franking machines, it goes without saying that it can also be used with the same advantages in any other desired printing devices.

We claim:

1. A printing device, comprising:

a print head movable along a first direction from a second longitudinal position into a first longitudinal position;

a station disposed to cooperate with said print head located in said first longitudinal position for one of cleaning, maintaining, and retaining said print head, said print head being movable toward said station in a second direction transverse to said first direction, for cooperating with said station; and a guide device configured to cooperate with said print head for guiding said print head in a movement in said second direction, said guide device including a guide element independently movable in a third direction transverse to said first direction for guiding said print head in a movement in said second direction.

2. The printing device according to claim 1, wherein said print head is disposed in a franking machine.

3. The printing device according to claim 1, wherein said print head is configured to be movable in the second direction.

4. The printing device according to claim 1, wherein said print head is mounted to be movable in the second direction.

5. The printing device according to claim 1, wherein said print head is pivotable about a pivot axis substantially parallel to the first direction.

6. The printing device according to claim 1, wherein said guide device is configured to effect the movement of said print head along the second direction.

7. The printing device according to claim 1, wherein a weight of said print head causes said print head to move toward said station in the second direction.

8. The printing device according to claim 1, wherein said print head includes printing elements, and said station includes a cap for covering the said printing elements of said print head.

9. The printing device according to claim 8, wherein said cap is mounted in a sprung manner in said station for generating a sealing force, at least along the second direction, when said cap cooperates with said print head.

10. The printing device according to claim 1, wherein said print head includes printing elements and said station includes a wiping device for wiping an outlet region of said printing elements of said print head.

11. The printing device according to claim 1, wherein:

said guide element is disposed on said station; and said station is movable in said third direction transverse to said first direction for guiding said print head in a movement in said second direction.

12. The printing device according to claim 1, wherein:

said guide device has a guide track and a guide pin cooperating with said guide track for guiding said print head in a movement in said second direction; and said guide pin is movable in relation to said guide track in said third direction for guiding said print head in a movement in said second direction.

13. The printing device according to claim 12, wherein:

said guide track is disposed on said print head;

said guide pin is disposed on said station; and said station is movable in said third direction transverse to said first direction for guiding said print head in a movement in said second direction.

14. A printing device, comprising:

a print head movable along a first direction from a second longitudinal position into a first longitudinal position, said print head having a bottom with a run-on face;

a station disposed to cooperate with said print head located in said first longitudinal position for one of cleaning, maintaining, and retaining said print head, said print head being movable toward said station in a second direction transverse to said first direction, for cooperating with said station; and a guide device formed with an inclined course to cooperate with said run-on face of said print head for guiding said print head in a movement in the second direction during a movement of the said print head along the first direction.

15. The printing device according to claim 14, which comprises a longitudinal guide channel for guiding said print head along the first direction.

16. A printing device, comprising:

a print head movable along a first direction from a second longitudinal position into a first longitudinal position, said print head having a hook-shaped attachment;

a station disposed to cooperate with said print head located in said first longitudinal position for one of cleaning, maintaining, and retaining said print head, said print head being movable toward said station in a second direction transverse to said first direction, for cooperating with said station; and a longitudinal guide channel configured to cooperate with said hook-shaped attachment of said print head for guiding said print head along the first direction and for guiding said print head in a movement in the second direction during the movement of said print head along the first direction.

17. A printing device, comprising:

a print head movable along a first direction from a second longitudinal position into a first longitudinal position, said print head having a run-on face and a spring;

a station disposed to cooperate with said print head located in said first longitudinal position for one of cleaning, maintaining, and retaining said print head, said print head being movable toward said station in a second direction transverse to said first direction, for cooperating with said station; and a guide track configured to cooperate with said run-on face of said print head for guiding said print head in a movement in the second direction during a movement of said print head along the first direction by pressing down said print head against said spring.

18. A printing device, comprising:

a print head movable along a first direction from a second longitudinal position into a first longitudinal position, said print head having a bottom with a run-on face;

a station disposed to cooperate with said print head located in said first longitudinal position for one of cleaning, maintaining, and retaining said print head, said print head being movable toward said station in a second direction transverse to said first direction, for cooperating with said station; and a guide track formed with a curved course to cooperate with said run-on face of said print head for guiding said print head in a movement in the second direction during a movement of said print head along the first direction by producing a linear lowering movement of said print head.

* * * * *

UNITED STATES PATENT AND TRADEMARK OFFICE

CERTIFICATE OF CORRECTION

PATENT NO. : 6,709,087 B2
APPLICATION NO. : 10/103328
DATED : March 23, 2004
INVENTOR(S) : Iain Ansell et al.

It is certified that error appears in the above-identified patent and that said Letters Patent is hereby corrected as shown below:

On the Title Page, Item (73) should read as follows:

Francotyp-Postalia AG & Co. KG, Birkenwerder (DE)

Signed and Sealed this

Second Day of October, 2007

JON W. DUDAS
*Director of the United States Patent and Trademark Office*